US009481014B2

(12) United States Patent
Rautamies

(10) Patent No.: US 9,481,014 B2
(45) Date of Patent: Nov. 1, 2016

(54) SIEVE SCREEN

(71) Applicant: Allu Finland Oy, Pennala (FI)
(72) Inventor: Antti Rautamies, Hollola (FI)
(73) Assignee: Allu Finland Oy, Pennala (FI)

( * ) Notice: Subject to any disclaimer, the term of this patent is extended or adjusted under 35 U.S.C. 154(b) by 0 days.
(21) Appl. No.: 14/825,717
(22) Filed: Aug. 13, 2015
(65) Prior Publication Data
US 2016/0059267 A1 Mar. 3, 2016
(30) Foreign Application Priority Data
Aug. 27, 2014 (FI) ..... 20145741
(51) Int. Cl.
*B07B 1/46* (2006.01)
*B02C 1/00* (2006.01)
*E02F 3/40* (2006.01)
(Continued)
(52) U.S. Cl.
CPC . *B07B 1/46* (2013.01); *B02C 1/00* (2013.01); *B07B 1/12* (2013.01); *B07B 1/15* (2013.01); *B07B 1/4636* (2013.01); *B07B 13/16* (2013.01); *E02F 3/40* (2013.01); *E02F 7/06* (2013.01)
(58) Field of Classification Search
CPC ..... B07B 1/12; B07B 1/15; B07B 1/46; B07B 1/4636; B02C 1/00
USPC ..... 209/254, 351
See application file for complete search history.

(56) References Cited

U.S. PATENT DOCUMENTS 3,515,274 A * 6/1970 Wehner ..... B07B 1/36 209/322
4,981,220 A * 1/1991 Kolodesh ..... A23N 1/003 209/691
(Continued)

FOREIGN PATENT DOCUMENTS

DE 20 2006 001 257 U1 6/2006
GB 2 219 949 A 12/1989
(Continued)

OTHER PUBLICATIONS

Extended European search report including the European search report and the European search opinion, for EP application No. 15180712.0, mailed Jan. 19, 2016, from the European Patent Office, Munich, Germany.
(Continued)

*Primary Examiner* — Terrell Matthews
(74) *Attorney, Agent, or Firm* — Sterne, Kessler, Goldstein & Fox P.L.L.C.

(57) ABSTRACT

The invention relates to a sieve screen, which can be positioned in a utility machine-operated screen bucket or in a screening station maneuverable with its own actuator. As shown in FIG. 7, a plurality of screening plates (3) are spaced from each other and establish a screening surface (2), which is provided with screening slots and on top of which can be placed the material to be screened. Rotatable shafts (4) are present below the screening surface (2). The shafts (4) feature blades (5), which protrude from the shafts and extend through the screening slots to above the screening surface (2). Fraction size is adapted to be changed without removing the shafts (4), by re-grouping the blades (5) and a necessary number of the screening plates (3). The blades (5) can be grouped in such a way on the shafts (4) that at least two blades (5) are set adjacent to each other and the adjacent blades are located within the same screening slot.

17 Claims, 4 Drawing Sheets

(51) Int. Cl.

| | |
|---|---|
| ***E02F 7/06*** | (2006.01) |
| ***B07B 1/12*** | (2006.01) |
| ***B07B 1/15*** | (2006.01) |
| ***B07B 13/16*** | (2006.01) |

(56) References Cited

U.S. PATENT DOCUMENTS

| | | | | |
|---|---|---|---|---|
| 8,307,987 | B2 * | 11/2012 | Miller | B03B 9/06 209/127.3 |
| 8,336,714 | B2 * | 12/2012 | Campbell | B07B 1/15 209/11 |
| 9,080,315 | B2 * | 7/2015 | Jonninen | B07B 1/15 |
| 2010/0282647 | A1 | 11/2010 | Miller et al. | |

FOREIGN PATENT DOCUMENTS

| | | | |
|---|---|---|---|
| JP | 2009-108581 | A | 5/2009 |
| NL | 1005998 | C2 | 3/1998 |
| WO | WO 01/14651 | A1 | 3/2001 |

OTHER PUBLICATIONS

Finnish Search Report for Finnish Patent Appl. No. 20145741, dated Apr. 13, 2015, Finnish Patent and Registration Office, Helsinki, Finland.

* cited by examiner

SIEVE SCREEN

FIELD OF THE INVENTION

The invention relates to a sieve screen, comprising:

a plurality of screening plates, spaced from each other and establishing a screening surface which is provided with screening slots and on top of which can be placed the material to be screened rotatable shafts below the screening surface, and blades which project from the shafts and extend through the screening slots to above the screening surface.

BACKGROUND

Such a sieve screen is known from the Applicant's German utility model DE 202006001257 U1. This prior known piece of equipment provides a good separating capability and high capacity with respect to other sieve screens available in the marketplace. Also, the screen obstruction problems are avoided even with wet materials and, if necessary, even small fraction sizes can be screened. However, this prior known sieve screen involves a drawback that each sieve screen bucket is only applicable to one fraction size. This drawback is also present in the sieve screen bucket disclosed in the Applicant's patent application FI 20135247.

SUMMARY OF THE INVENTION

It is an object of the invention to obviate this drawback and to provide a sieve screen of the above-mentioned type, which can be assembled or modified easily and quickly for a capability of screening various fraction sizes while using similar or the same screening plates and blades.

This object is attained in the invention with a sieve screen presented in the appended claim 1. The dependent claims present preferred embodiments of the invention.

A sieve screen of the invention can be placed in a utility machine-operated screen bucket or the sieve screen can also be placed in a screening station movable with its own actuator.

In a sieve screen of the invention, the screening surface is not moving as opposed to generally known screening methods. The screening surface consists of stationary screening plates and the movement of a material to be screened over the sieve screen or across the sieve screen is achieved with blades rotated by shafts present below the screening surface and extending through the screening surface. This design enables the construction of a robust screening surface, whereby pre-screening prior to fine screening is not absolutely necessary. The screening operation can also be activated with the material already on top of the sieve screen, because the driving force required by the blades is hardly dependent on the amount of material on top of the sieve screen but solely on the type of material. Hence, this also enables the screening on a batch principle, such as the use as a bucket machine attachment, wherein material is collected into a bucket and the screening is not started until thereafter. The sieve screen also enables a more efficient use of the screening surface and thereby a higher capacity per screening area than methods based solely on gravity, since the fine material is forced by means of rotating blades rapidly through the sieve screen, whereby the throughput time can be influenced by the speed of the blades and the power to be applied. This makes it possible to manufacture high capacity compact sieve screens.

BRIEF DESCRIPTION OF THE DRAWINGS

One exemplary embodiment of the invention will now be described more closely with reference to the accompanying drawings, in which.

DETAILED DESCRIPTION

Figure 1:
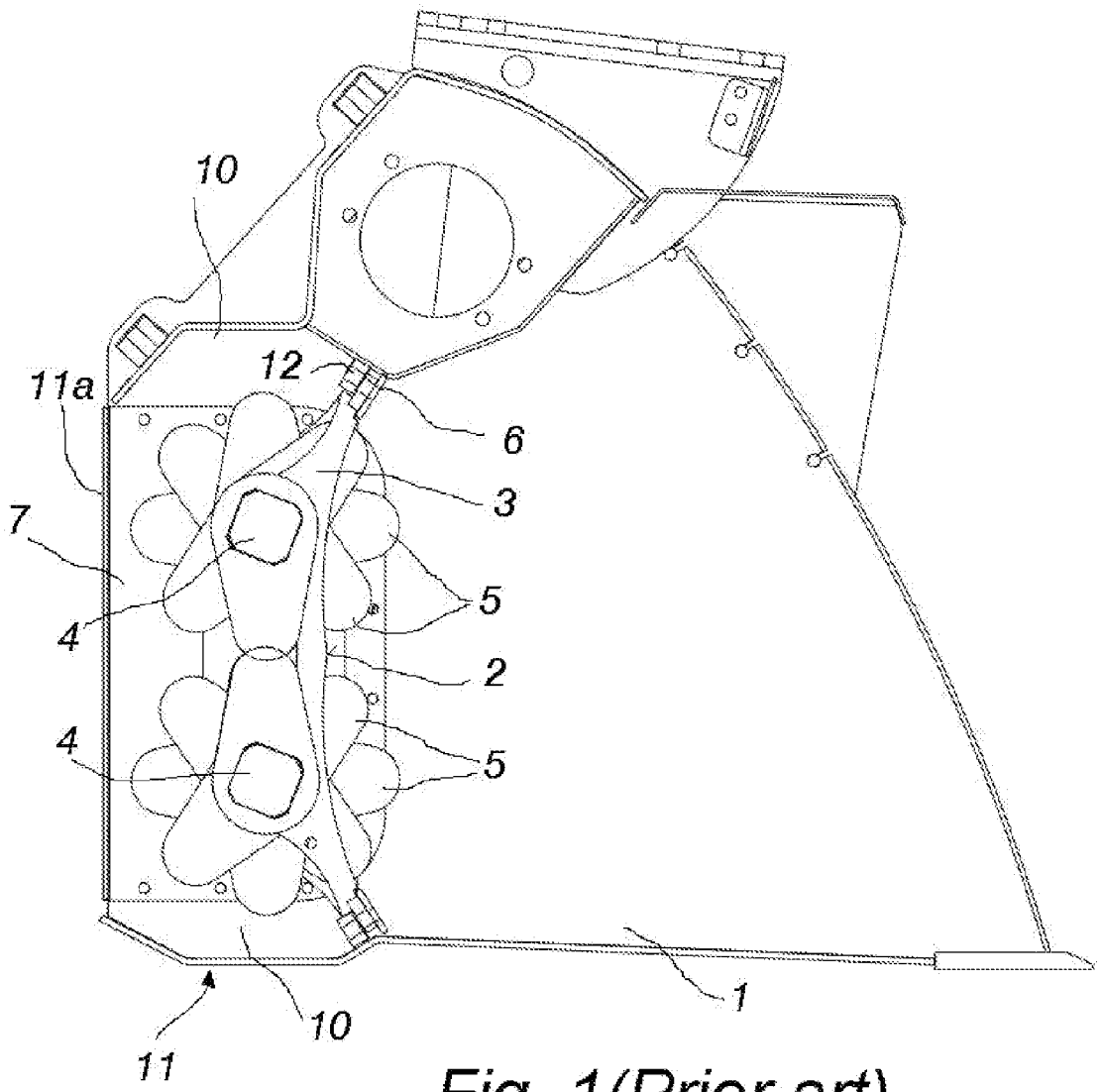
Fig. 1(Prior art)
FIG. 1 shows a sieve screen bucket of the prior art in cross-section when positioned in an excavator bucket 1.
Figure 2:
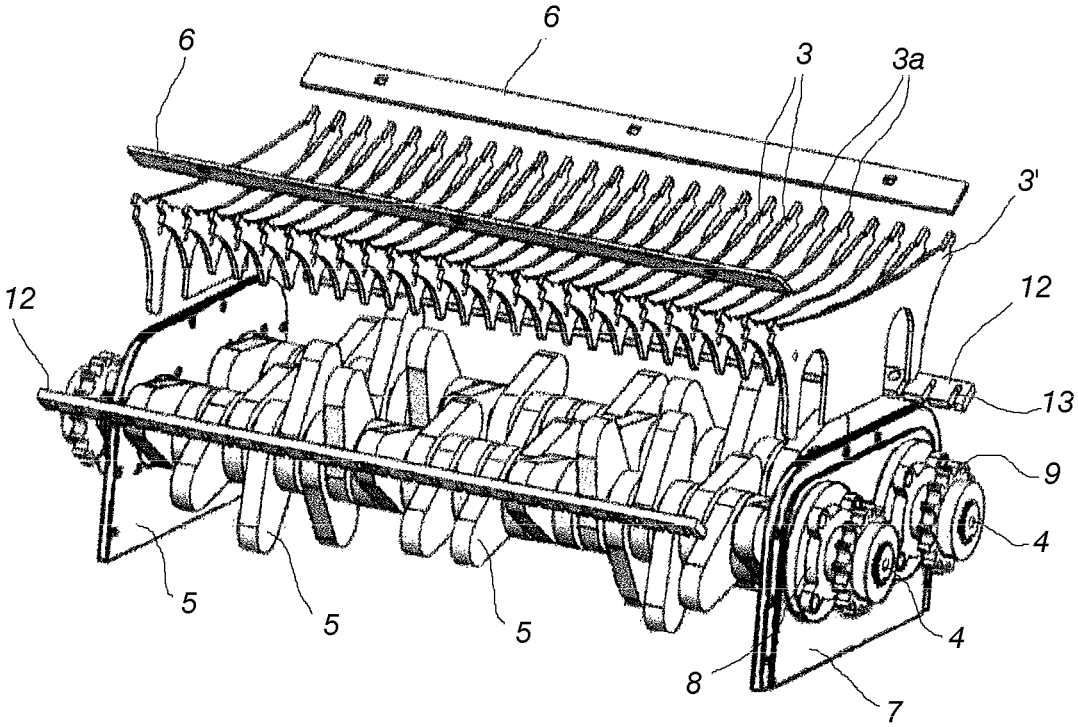
Fig. 2(Prior art)
FIG. 2 shows, in an assembly drawing, a sieve screen for the sieve screen bucket of FIG. 1 when removed from the bucket. A sieve screen cartridge unit is capable of being installed in the bucket across an open rear side of the bucket.
Figure 3:
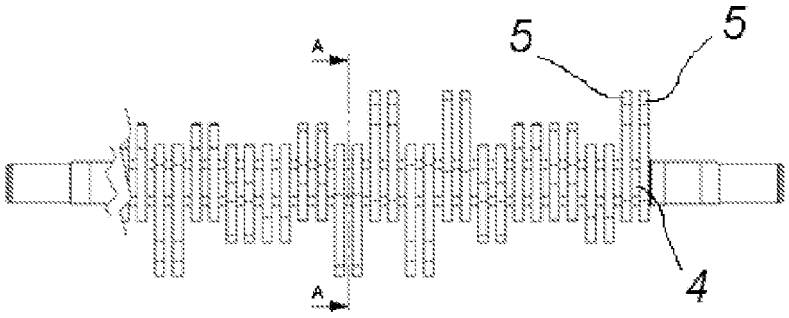
FIG. 3 shows a shaft with its blades for the sieve screen of the invention, the blades being sized in terms of thickness to match a minimum fraction size

First described is the prior art as shown in FIGS. 1 and 2, which provides a basis for the present invention and which makes up an evolution of the present invention. The sieve screen comprises a screening surface 2 provided with slots, on top of which can be placed a material to be screened. Screening coarseness is determined by the width of the slots. The screening surface is constructed in such a way that the ends of separate screening plates 3 are fixed between flat mounting bars 6 and 12 which retain the screening plates 3 at a distance from each other matching the screening slot. In the present case, the flat mounting bars 6 and 12 extend continuously across the entire length of an edge of the screening surface 2, but the flat mounting bars can also be divided into several sections. The flat mounting bars 6 and 12 are attachable to the fastening lips of a bucket frame. The screening plates 3 are as thin as possible from the standpoint of structural strength, thus providing a maximal capacity per unit area of the screening surface. The screening slots extend continuously across the entire distance between the flat mounting bars 6, thus avoiding the formation of unnecessary obstacles to the material flow-through.

Present below the screening surface 2 are rotatable shafts 4, fitted with projecting blades 5 which rotate along with the shafts 4 and extend through the screening slots to above the screening surface 2. The blades 5 have an extent in the range of 1-40 mm above the screening surface 2. With this dimensioning of blades, the blades are on the one hand enabled to convey through the sieve screen a material capable of fitting in the screening slots and, on the other hand, to push along the screening surface a material not fitting in the slots. In a preferred embodiment of the invention, the screening plates can be adjustable in the direction perpendicular to a plane surface extending by the shafts 4 for changing the extent of protrusion of the blades 5 above the screening surface 2. The inter-shaft distances and the length of the blades 5 are preferably dimensioned in such a way that the entire volume of screening slots between the screening plates 3 will be swept by the blades 5. Thereby, between the plates 3 remain no blind spots for the material to stick. Small blind spots can be tolerated, since, outside these spots, the blades 5 in any event take care of maintaining the sieve screen in a continuously open condition. Therefore, the only drawback of small blind spots is a slight reduction of the sieve screen capacity per unit area in case the blind spots are obstructed.

The shafts 4 are driven in the same direction, whereby the material not fitting through the sieve screen is continuously revolving in the same direction instead of building a plug on top of the screening surface. After the screening, the only items left inside the sieve screen bucket 1 are rocks or other hard pieces incapable of passing through the sieve screen.

In a sieve screen of the invention, the blades 5 are freely movable on the shafts 4 in axial direction. All that is transmitted by the shafts 4 to the blades 5 is a torque. The shafts 4 are polygonal in cross-section, and each blade 5 has a collar element, which extends around the shaft and from which projects the actual blade 5. Accordingly, the blade 5 in all of its rotational positions, i.e. at all of the rotational angles of the shaft 4, lies at least partially between the screening plates 3 under control of the screening plates. Hence, the screening plates 3 retain a position perpendicular to the screening surface 2. Thus, the blades 5 are sort of like slabs having a thickness which is substantially equal to the width of a screening slot between the screening plates 3.

The distance between the shafts 4 is slightly less than the diameter of a circle drawn by a tip of the blade 5. Thus, the parallel shafts 4 must have the positions of their blades synchronized in such a way that the ends of the blades 5 do not coincide in the same slot. In FIG. 1 there is intentionally shown an incorrect position, wherein the ends of the blades are overlapped, i.e. would collide with each other unless said positional synchronization were present.

In order to have the slots between the screening plates 3 swept by the blades 5 without substantial blind spots, and without having to reduce the inter-shaft distance such that the synchronization of blades would become a problem, the screening surface 2 has been designed as a downward concave arch and possibly to be slightly undulating. In addition, it must be taken care of that between a lateral surface of the screening surface-approaching blade 5 and the screening surface be always left a sufficiently large angle, such that hard pieces not fitting in the screening slots become conveyed along the screening surface instead of being jammed between the blade and the screening surface. This is why the blades 5 taper in a wedge-like manner towards their rounded tips. The sides of blades 5 are substantially straight with an angle between the same in the range of 20-28°. This is also partly influenced by the fact that the blade must not extend above the screening surface higher than a certain maximum distance. There are other options of designing the blades, for example as tools crushing the material to be screened.

The screening plates 3 have their bottom edges provided with recesses for receiving the shafts 4, whereby the screening plates 3 extend partially into a space between the shafts 4. In a loaded condition, the screening plates 3 may be supported in their mid-sections on the shafts 4, i.e. the recesses may have their bottoms leaning against the shafts 4 as necessary.

A turning motor for the shafts can be disposed in an enclosure at an upper portion of the bucket, and the rotation drive such as chains and gears can be disposed in an enclosure 11 at a side wall of the bucket. The earth material to be screened is collected into the bucket, and the bucket is turned over to a screening position in which the sieve screen is in a slightly tilted position for the material to be conveyed by the blades 5 on top of the screening surface 2 in a slightly uphill direction. In this case, the material does not become packed at the end in the conveying direction, but circulates on top of the sieve screen until all the material fitting through the sieve screen has vacated the bucket.

Figure 4:
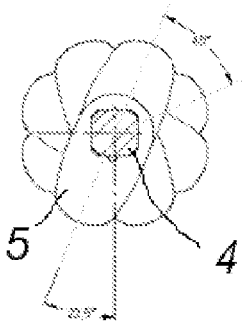
FIG. 4 shows a section taken from FIG. 3 along a line A-A
Figure 5A:
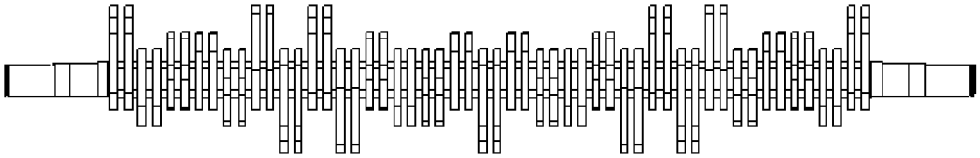
FIG. 5*a* shows the shaft with its blades according to FIGS. 3 and 4 with the blades set in a position matching the minimum fraction size
Figure 5B:
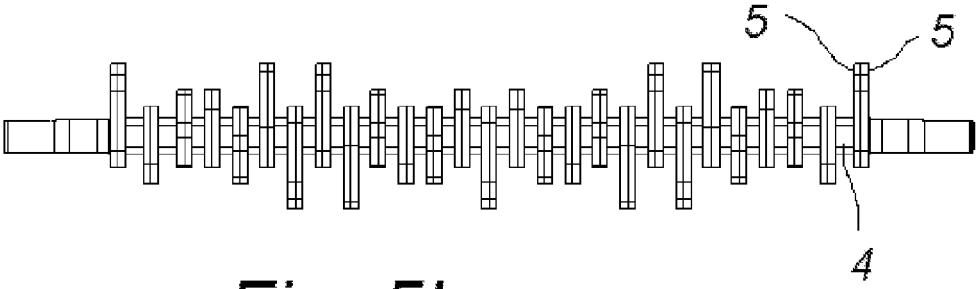
FIGS. 5*b* and 5*c* show the same shaft as FIG. 5*a*, but the blades have been displaced and grouped in a direction of the shaft so as to have two blades each time adjacent to each other without an intervening gap
Figure 5C:
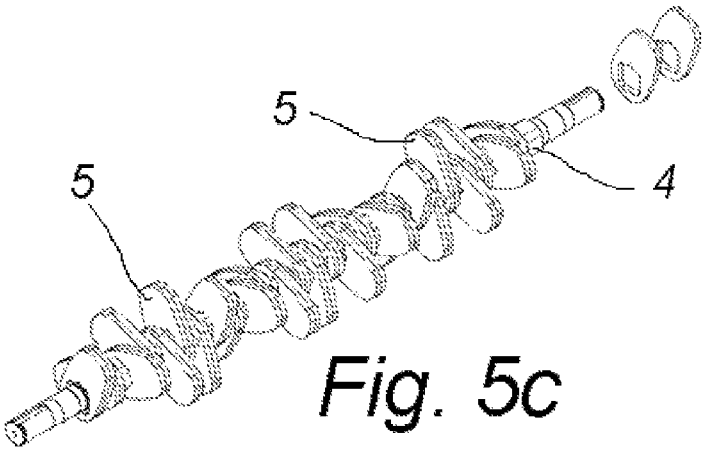
Figure 6:
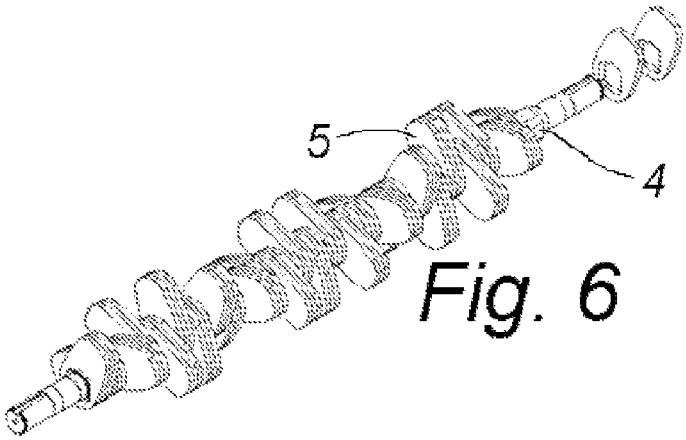
FIG. 6 shows the same shaft as FIG. 5*a*, but the blades have been displaced and grouped in a direction of the shaft so as to have three blades each time adjacent to each other without an intervening gap.

FIG. 4 shows in more detail the shape and disposition of a blade 5 on a square-shaped shaft 4. Various angular positions of the blades are used for setting the blades in a spiral fashion on each shaft. The blades 5 have their square hole at an angle of 22.5 degrees relative to a center line of the blade. Accordingly, a single type of blade can be set on the shaft in eight different positions (four positions in each direction), whereby the minimum phase difference between two blades will be 45 degrees.

Unlike the others, the outermost screening plate 3 is designed to extend deep around and below the shafts 4 adjacent to the penetrations of fastening plates 7. Hence, these screening plates 3' provide mudguards which block the entrance of dirt into penetrations of the fastening plates 7, and thereby to bearings 8 which are mounted on the outer sides of the fastening plates 7.

The fastening plates 7, and the shafts 4, along with their blades 5, fixed (bearing-mounted) thereon, make up a cartridge unit capable of being installed in a single entity from the rear side of the bucket 1 by pushing the fastening plates 7 in the direction of their plane into reception openings in frame plates 10 of the bucket and by securing the fastening plates 7 with bolts to the bucket's frame plates 10. The fastening plates 7 are double-layered, such that the edges develop a staggered fastening flange. The fastening plates 7 make up internal walls for the drive enclosures 11. After installation, the rear sides of the drive enclosures 11 are closed with rear walls 11*a*. The screening plates 3 to be placed between the blades 5 are set in position one by one from a forward side of the bucket. Attached to the bucket frame are elastic flat mounting bars 12 of e.g. elastomer, whose grooves 13 take up ends 3*a* of the screening plates 3 and guide these to their positions. Finally, the screening plates 3 are secured by fixing the flat mounting bars 6 on top of their ends 3*a*.

New features of the invention will now be described with reference to FIGS. 3-7. The invention differs from the foregoing prior art shown in FIGS. 1 and 2 in the sense that there is provided a possibility of various groupings for the screening plates 3 and the blades 5 according to a desired fraction size. The thickness of the blades 5 is designed to match a minimum fraction size. Various groupings of the screening plates 3 and the blades 5 can be used for doubling or tripling etc. the original minimum fraction size determined by a single blade thickness. Being freely movable in axial direction along the shaft 4, the blades 5 can be grouped so as to have each time two (or three etc.) blades 5 adjacent to each other without an intervening gap. Respectively, two (or three etc.) screening plates 3 are each time set adjacent to each other without an intervening gap. Thus, the screening slots become respectively larger and fewer. However, it is possible to use the same screening plates and blades in constructing sieve screens capable of screening various fraction sizes. It is only the flat mounting bars 12 (FIG. 2) that need be replaced in order to enable locations of the installation grooves 13 to match each time a desired grouping of the screening plates 3.

Figure 7:
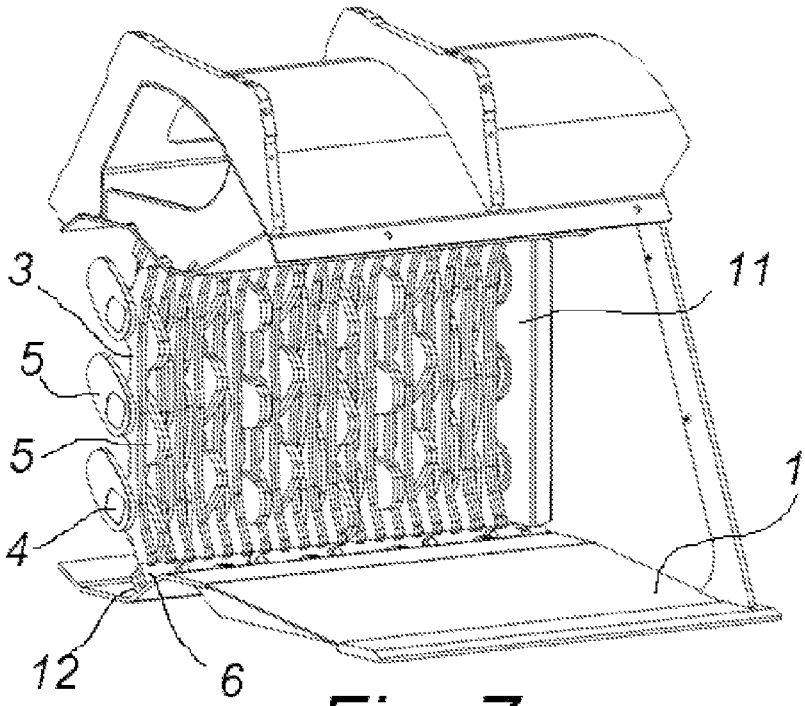
FIG. 7 shows, in a perspective view, a portion of the sieve screen of the invention when placed in a sieve screen bucket. The sieve screen features shafts 4 provided with an arrangement of blades 5 according to FIGS. 5*b* and 5*c*, whereby the screening plates are respectively set in pairs without an intervening screening slot, the gaps between the screening plate sets matching the thickness of the blade sets.

FIG. 7 shows at each edge of the sieve screen two groups of three adjacent screening plates and in the middle the screening plates are set in adjacent to each other in pairs. The blades 5 are set adjacent to each other in pairs and the blades of each blade set are in the same screening slot. The adjacent blades can be in the same or different phases, i.e. positions of rotation angle. The number of screening plates and blades in each group need not match each other. The number of screening plates in each group can be varied for example in order to adapt the width of a sieve screen to the width of a bucket. Although, even in the process of screening coarser fractions, there could be just one screening plate between two adjacent screening slots, it is preferred from the standpoint of the strength and load-bearing capacity of a sieve screen that between two screening slots closest to each other there will be at least two screening plates 3 which are set adjacent to each other without an intervening gap. Depending on the thickness of a screening plate, the change of a fraction size according to the invention can also be implemented in such a way that there is just one screening plate 3 between two screening slots closest to each other.

As is apparent from the foregoing, the screening plates 3 extend in such a way into spaces between blade groups made up by the blades 5 that the blades are partially within the screening slots in all rotation angle positions of the shaft 4, whereby the locations of blades and blade groups on the shaft 4 are determined by the screening plates. As a result, the blades set automatically in position in a direction of the shaft 4 and remain stationary. There will be no dimensioning problems for as long as the screening slots are sized according to the thickness of blade groups. A sieve screen of the invention can also be constructed in such a way that the gap left between screening plates 3 is larger than the thickness of a blade 5 or a blade group made up by adjacent blades, whereby rotation of the blade or the blade group between screening plates is guided either according to the screening plates or by means of separate mechanical spacer blocks mounted on the shaft. The mechanical spacer blocks can be e.g. half bushings of suitable length, from whose edges protrude fastening flanges which can be fastened with bolts against each other for thereby mounting the spacer blocks on the shaft 4 without removing the shafts.

What is achieved with the foregoing design is the important feature of the invention of being able to change the fraction size without removing the shafts 4, by re-grouping the blades 5 and a necessary number of the screening plates 3.

The invention claimed is:

1. A sieve screen, comprising:

a plurality of screening plates (3), spaced from each other and establishing a screening surface (2) which is provided with screening slots and on top of which can be placed the material to be screened, rotatable shafts (4) below the screening surface (2), and blades (5) which project from the shafts (4) and extend through the screening slots to above the screening surface (2), but characterized in that the fraction size is adapted to be changed without removing the shafts (4), by re-grouping the blades (5) and a necessary number of the screening plates (3).

2. A sieve screen according to claim 1, characterized in that the blades (5) are grouped on the shafts (4) in such a way that at least two blades (5) are set in each group adjacent to each other and the adjacent blades are within the same screening slot while the adjacent blades are in the same of different phases, i.e. positions of rotation angle.

3. A sieve screen according to claim 1 or 2, characterized in that between each two screening slots closest to each other there are at least two screening plates (3), which are set adjacent to each other.

4. A sieve screen according to claim 1 or 2, characterized in that the screening plates (3) extend in such a way into spaces between blade groups made up by the blades (5) that the blades are partially within the screening slots in all rotation angle positions of the shaft (4), whereby locations of the blades and the blade groups on the shaft (4) are determined by the screening plates.

5. A sieve screen according to claim 1 or 2, characterized in that the screening plates (3) have their ends in grooves (13) present on a flat mounting bar (12) at a distance from each other which matches the distance between the screening plates and respectively the size of a screening slot.

6. A sieve screen according to claim 1 or 2, characterized in that the gap left between screening plates (3) is larger than the thickness of a blade (5) or a blade group made up by adjacent blades, whereby rotation of the blade or the blade group between screening plates is guided either according to the screening plates or by means of separate mechanical spacer blocks mounted on the shaft.

7. A sieve screen according to claim 1 or 2, characterized in that the sieve screen is located in a sieve screen bucket (1) operable with a utility machine.

8. A sieve screen according to claim 3, characterized in that the screening plates (3) extend in such a way into spaces between blade groups made up by the blades (5) that the blades are partially within the screening slots in all rotation angle positions of the shaft (4), whereby locations of the blades and the blade groups on the shaft (4) are determined by the screening plates.

9. A sieve screen according to claim 3, characterized in that the screening plates (3) have their ends in grooves (13) present on a flat mounting bar (12) at a distance from each other which matches the distance between the screening plates and respectively the size of a screening slot.

10. A sieve screen according to claim 4, characterized in that the screening plates (3) have their ends in grooves (13) present on a flat mounting bar (12) at a distance from each other which matches the distance between the screening plates and respectively the size of a screening slot.

11. A sieve screen according to claim 3, characterized in that the gap left between screening plates (3) is larger than the thickness of a blade (5) or a blade group made up by adjacent blades, whereby rotation of the blade or the blade group between screening plates is guided either according to the screening plates or by means of separate mechanical spacer blocks mounted on the shaft.

12. A sieve screen according to claim 4, characterized in that the gap left between screening plates (3) is larger than the thickness of a blade (5) or a blade group made up by adjacent blades, whereby rotation of the blade or the blade group between screening plates is guided either according to the screening plates or by means of separate mechanical spacer blocks mounted on the shaft.

13. A sieve screen according to claim 5, characterized in that the gap left between screening plates (3) is larger than the thickness of a blade (5) or a blade group made up by adjacent blades, whereby rotation of the blade or the blade group between screening plates is guided either according to the screening plates or by means of separate mechanical spacer blocks mounted on the shaft.

14. A sieve screen according to claim 3, characterized in that the sieve screen is located in a sieve screen bucket (1) operable with a utility machine.

15. A sieve screen according to claim 3, characterized in that the sieve screen is located in a sieve screen bucket (1) operable with a utility machine.

16. A sieve screen according to claim 3, characterized in that the sieve screen is located in a sieve screen bucket (1) operable with a utility machine.

17. A sieve screen according to claim 3, characterized in that the sieve screen is located in a sieve screen bucket (1) operable with a utility machine.

* * * * *